US006874455B2

(12) United States Patent
Geyer et al.

(10) Patent No.: US 6,874,455 B2
(45) Date of Patent: Apr. 5, 2005

(54) TWO-CYCLE ENGINE

(75) Inventors: Werner Geyer, Berglen (DE); Claus Fleig, Ludwigsburg (DE); Jörg Schlossarczyk, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/439,080

(22) Filed: May 15, 2003

(65) Prior Publication Data

US 2003/0217710 A1 Nov. 27, 2003

(30) Foreign Application Priority Data

May 24, 2002 (DE) ..... 102 23 069

(51) Int. Cl.[7] ..... F02B 33/04
(52) U.S. Cl. ..... 123/73 PP
(58) Field of Search ..... 123/73 PP, 73 A, 123/65 A

(56) References Cited

U.S. PATENT DOCUMENTS 6,289,856 B1 * 9/2001 Noguchi ..... 123/73 PP
6,497,204 B1 12/2002 Miyazaki et al.
6,571,756 B1 * 6/2003 Rosskamp et al. ..... 123/73 PP
6,691,650 B2 * 2/2004 Zama et al. ..... 123/73 PP

FOREIGN PATENT DOCUMENTS

| | | |
|---|---|---|
| WO | WO 00/43650 | 7/2000 |
| WO | WO 00/65209 | 11/2000 |
| WO | WO 01/51783 | 7/2001 |

* cited by examiner

*Primary Examiner*—Tony M. Argenbright
*Assistant Examiner*—Hyder Ali
(74) *Attorney, Agent, or Firm*—Robert W. Becker & Associates; Robert W. Becker

(57) ABSTRACT

A two-cycle engine, especially in a portable, manually-guided implement, is provided, and has a combustion chamber that is formed in a cylinder and is delimited by a reciprocating piston, which via a connecting rod drives a crankshaft mounted in a crankcase. The engine has an inlet and an outlet, as well as at least one transfer channel that, in prescribed positions of the piston, connects the crankcase with the combustion chamber. An air channel that conveys essentially fuel-free air is, in prescribed positions of the piston, fluidically connected via a piston window with an inlet window of a transfer channel into the combustion chamber. For a good scavenging result, the flow resistance through the transfer channel in the direction of flow from the crankcase to the combustion chamber corresponds approximately to the flow resistance in the direction of flow from the combustion chamber to the crankcase.

16 Claims, 4 Drawing Sheets

TWO-CYCLE ENGINE

BACKGROUND OF THE INVENTION

The present invention relates to a two-cycle engine, especially in a portable, manually-guided implement such as a power chain saw, a cut-off machine, or the like.

WO 00/65209 discloses a two-cycle engine according to which crankcase and combustion chamber, in certain positions of the piston, are fluidically interconnected via four transfer channels. Via these transfer channels, fuel/air mixture flows into the combustion chamber. To separate the fuel/air mixture from the exhaust gases, fresh air stored in the transfer channels is introduced ahead of the mixture. The fresh air flows via an air inlet and piston window into the transfer channels, and, in the scavenging phase, prevents fresh mixture from flowing away into the outlet.

It is an object of the present invention to provide a two-cycle engine of the aforementioned general type that has an optimized scavenging result.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
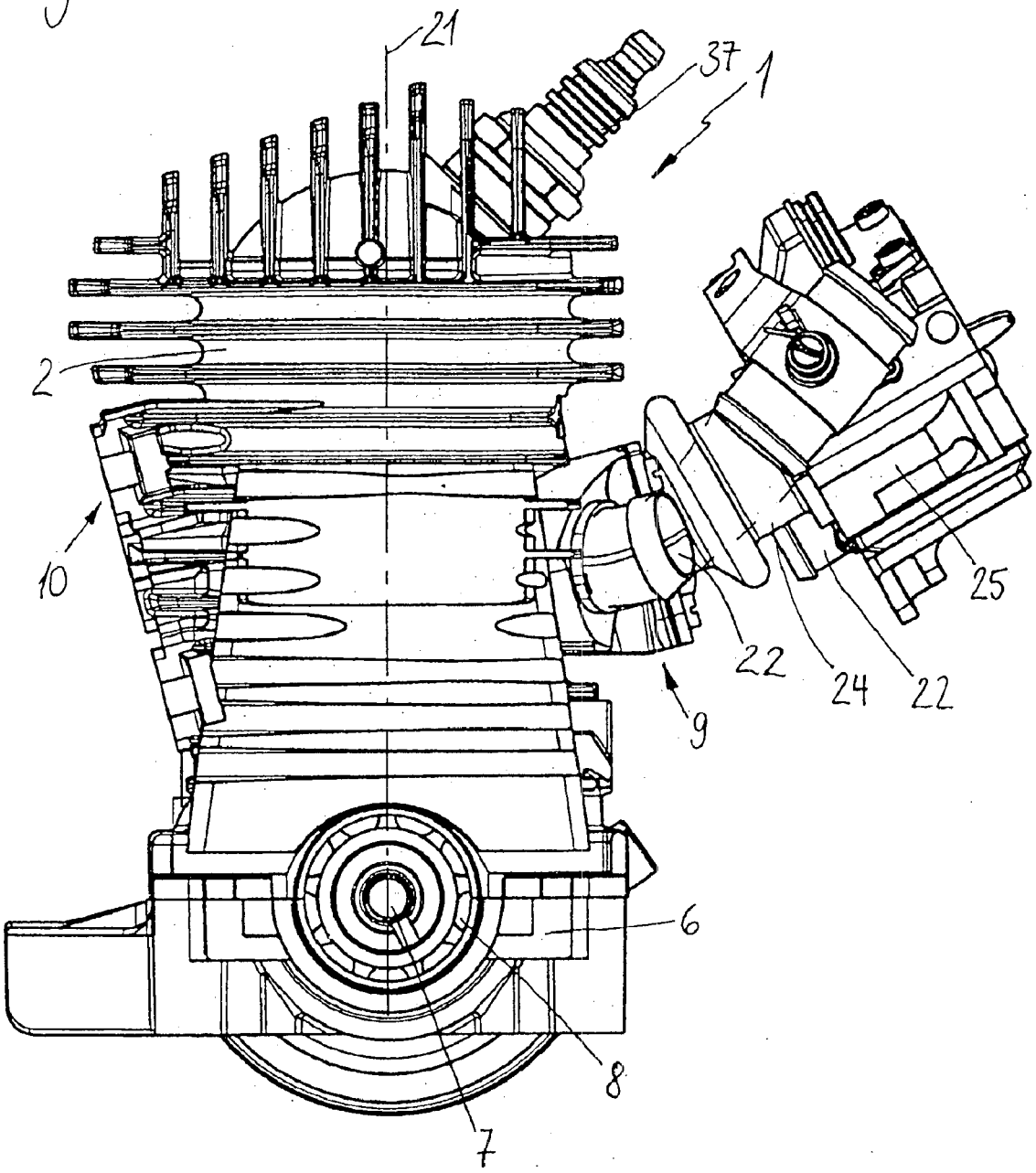
FIG. 1 is a side view of a two-cycle engine.

The two-cycle engine of the present invention comprises a cylinder in which is formed a combustion chamber that is delimited by a reciprocating piston that, via a connecting rod, drives a crankshaft that is rotatably mounted in a crankcase, wherein an inlet is provided for a supply of fuel/air mixture into the crankcase, wherein an outlet is disposed approximately opposite the inlet for exhaust gas from the combustion chamber, wherein at least one transfer channel is provided for fluidically connecting the crankcase with the combustion chamber in prescribed positions of the piston, wherein the transfer channel opens into the combustion chamber via an inlet window and opens into the crankcase via an outlet window, wherein the transfer channel has a rising section that extends approximately parallel to the longitudinal axis of the cylinder, and an inlet section into the combustion chamber, wherein an air channel is provided for conveying air that is essentially free of fuel, wherein in prescribed positions of the piston, the air channel is fluidically connected via a piston window with the inlet window of the transfer channel, and wherein the transfer channel has a flow resistance therethrough in a direction of flow from the crankcase to the combustion chamber that corresponds approximately to a flow resistance therethrough in a direction of flow from the combustion chamber to the crankcase.

It has been shown that for the quantity of the previously stored air, the shape or form of the transfer channels has a decisive influence. The transfer channels were optimized in previous designs, especially with regard to the fuel/air mixture that flows into the combustion chamber. In order now with a scavenging engine to also achieve a good clean air scavenging result, the flow resistance through the transfer channel in the direction of flow from the combustion chamber to the crankcase is provided such that it corresponds approximately to the flow resistance in the direction of flow from the crankcase to the combustion chamber. In this way, within the time available, due to the flow properties that are optimized in both directions a good filling of the transfer channels with previously stored fresh air is achieved.

The flow cross-section in the transfer channel is expediently nearly constant, whereby the change of the flow cross-section is 0 to 15% of the flow cross-section in the outlet window. Due to the small change of the flow cross-section over the length of the transfer channel, a separation of the flow from the walls, and turbulence in the transfer channel, are avoided. The flow cross-section in the transfer channel advantageously decreases from the crankcase to the combustion chamber, especially in the region of the change in direction and shortly prior to entry into the combustion chamber. Favorable flow conditions are achieved if the ratio of the width of the transfer channel measured in the circumferential direction to the height over the length of the transfer channel measured perpendicular to the width and to the direction of flow is approximately constant. A low overall width of the two-cycle engine can be achieved in particular with transfer channels having a flow cross-section with an approximately square or rectangular shape, whereby in particular the height in the outlet window corresponds to 10 to 40% of the width in the outlet window. Favorable flow conditions result in particular in long, narrow transfer channels. The width in the outlet window expediently corresponds to 10 to 40%, especially 20 to 35%, of the length of the transfer channel, and the height in the outlet window advantageously corresponds to 2 to 15%, especially 4 to 10%, of the length of the transfer channel. For a uniform scavenging pattern, it is provided that two transfer channels that are close to the outlet, and two transfer channels that are remote from the outlet, be disposed symmetrically relative to the central plane of the cylinder.

For a complete filling of the transfer channels with air, it is provided that a transfer channel that is remote from the outlet at least partially span the air channel, whereby the distance between air channel and transfer channel is approximately constant over the width of the transfer channel that is remote from the outlet. The arrangement of the air channel below the inlet window into the combustion chamber of the transfer channel that is remote from the outlet enables short flow paths in the piston window and hence a good filling of the transfer channels.

The arrangement of the air channel below the inlet window that is remote from the outlet enables a compact construction of the cylinder. The side walls of the transfer channel that is remote from the outlet that are disposed in the direction of the width advantageously extend approximately parallel to the central plane of the cylinder. As a result of this arrangement, and with an optimum scavenging flow direction, the overall volume that is available can be well utilized.

Favorable flow conditions in both directions of flow result with an approximately right-angled deflection or change in direction of the fluid stream in the transfer chamber. For this purpose, it is provided that that side wall of the transfer channel that is disposed outwardly in a radial direction extends, in a rising section, approximately perpendicular to the direction of flow in the inlet section. In order to ensure a good flowing-in of the air from the air channel into the transfer channel, it is provided that the transfer channel be rounded off toward the combustion chamber at that edge of the inlet window that faces the crankcase. The resistance of flow from the air channel via the piston window into the inlet window of the transfer channels is thereby reduced, and a separation of the clean air that is flowing in is avoided.

For a good scavenging result, the sum of the values of all of the transfer channels is 25 to 50%, especially about 30%, of the stroke volume or piston displacement of the two-cycle engine. With this volume of the transfer channels, there results a good separation of exhaust gases and fuel/air mixture via the air that is previously stored in the transfer channels.

Further specific features of the present invention will be described in detail subsequently.

DESCRIPTION OF PREFERRED EMBODIMENTS

Figure 2:
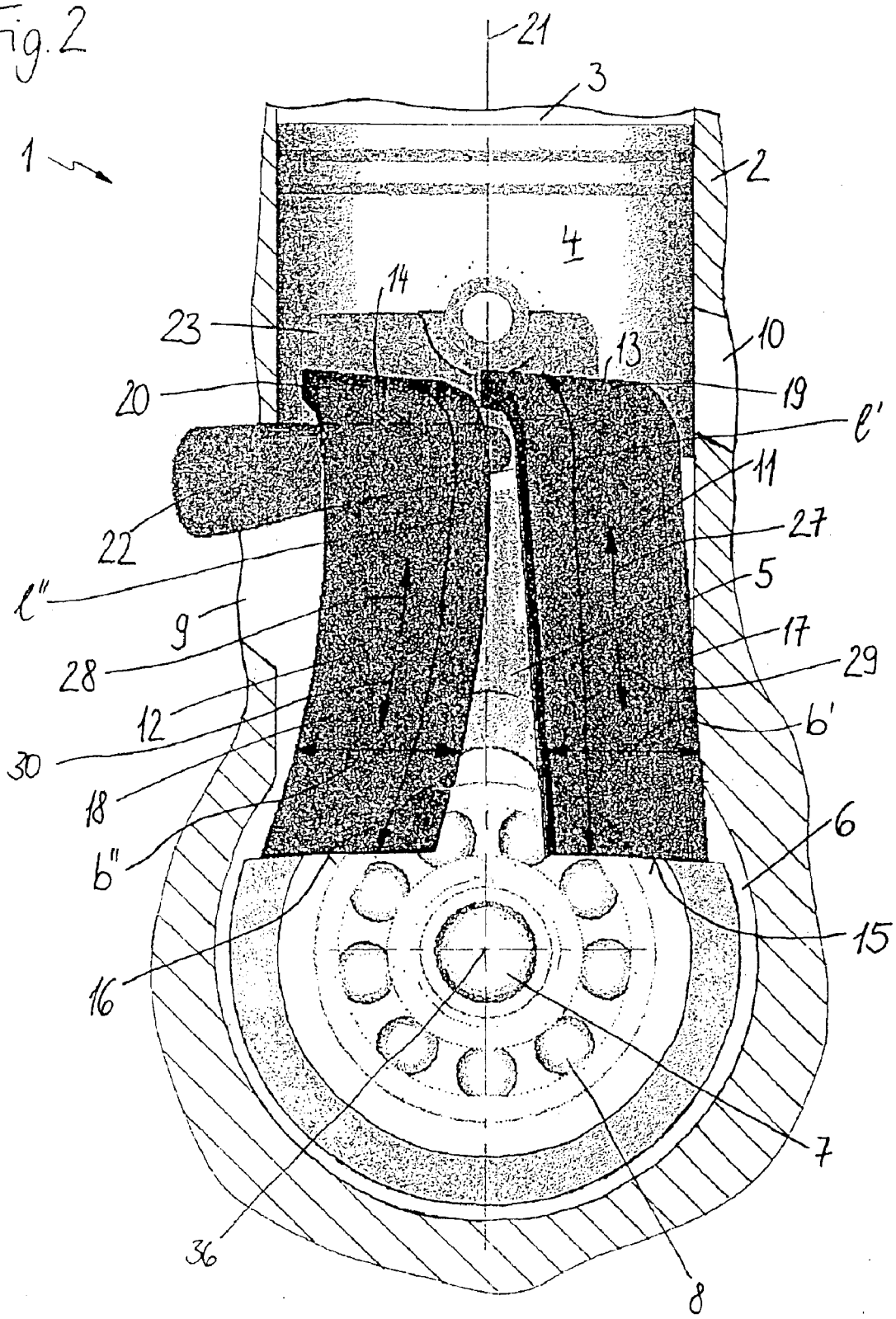
FIG. 2 is a partially cross-sectioned illustration of a two-cycle engine.

Referring now to the drawings in detail, the two-cycle engine 1, which is illustrated in a side view in FIG. 1, has a cylinder 2 and a combustion chamber 3 that is formed in the cylinder 2 and is illustrated in FIG. 2. The combustion chamber 3 is separated from the crankcase 6 by the piston 4 that is illustrated in FIG. 2. Fuel/air mixture is supplied via the inlet 9 to the crankcase 6. This mixture is prepared in the carburetor 25, which is illustrated in FIG. 1, and is supplied to the inlet 9 via the intake channel 24. Furthermore, air that is largely fuel-free is supplied to the two-cycle engine 1 via two air channels 22 that are disposed on both sides of the intake channel 24. Formed in the cylinder 2 is the outlet 10, which withdraws exhaust gases from the combustion chamber 3. The crankshaft 7 is rotatably mounted in the crankcase 6 via a bearing means 8, especially a roller bearing.

The two-cycle engine 1 is schematically illustrated in FIG. 2. The cylinder 2 and the crankcase 6 are illustrated in cross-section, while the piston 4, air channel 22, the transfer channels 11 and 12 and the crankshaft 7 with the bearing means 8 are illustrated in a side view. The piston 4, which separates the combustion chamber 3 from the crankcase 6, drives the crankshaft 7 via the connecting rod 5. The piston 4 moves in the cylinder 2 from the upper dead center position illustrated in FIG. 2, along the longitudinal axis 21 of the cylinder, to the lower dead center position, and back. The stroke volume or piston displacement of the two-cycle engine is the difference between the volume of the combustion chamber 3 in the upper dead center position of the piston 4 and the volume of the combustion chamber 3 in the lower dead center position of the piston 4. Fuel/air mixture is supplied via the inlet 9 to the crankcase 6. During a downward movement of the piston 4 from the upper dead center position in a direction toward the crankcase 6, the fuel/air mixture is compressed in the crankcase 6.

In the region of the upper dead center position, the crankcase 6 is fluidically connected with the combustion chamber 3 via the transfer channels 11 and 12. Fuel/air mixture flows from the crankcase 6 into the combustion chamber 3 via the transfer channels 11, 12. During movement of the piston 4 from the lower dead center position in a direction toward the upper dead center position, the fuel/air mixture in the combustion chamber 3 is compressed, and in the vicinity of the upper dead center position is ignited by the spark plug 37 that is illustrated in FIG. 1. During the subsequent movement of the piston 4, in the direction toward the crankcase 6, the outlet 10 is opened and the exhaust gases flow out of the combustion chamber 3 via the outlet 10. While the exhaust gases escape from the combustion chamber 3, fresh fuel/air mixture already flows back into the combustion chamber 3 via the transfer channels 11, 12.

To reduce scavenging losses, fresh air stored in the transfer channels 11 and 12 is introduced ahead of the fuel/air mixture from the crankcase 6. In the vicinity of the upper dead center position, the inlet windows 13, 14, via which the transfer channels 11, 12 open out into the combustion chamber 3, are fluidically connected with the air channel 22 via a piston window 23 that is formed in the piston 4. Via the piston window 23, the air channel 22 supplies air that is largely free of fuel to the transfer channels 11, 12. When viewed in the direction of the longitudinal axis 21 of the cylinder 2, the air channel 22 is offset in a direction toward the crankcase 6 relative to the inlet window 14 of that transfer channel 12 that is remote from the outlet 10.

The transfer channels 11, 12 have a rising section 17, 18, which extends approximately parallel to the longitudinal axis 21 of the cylinder 2, and an inlet section 19, 20, which extends at an angle to the rising section. The transfer channel 11 that is near the outlet 10 opens via an outlet window 15 into the crankcase 6, and the transfer channel 12 that is remote from the outlet 10 opens into the crankcase via an outlet window 16. The outlet windows 15, 16 of the transfer channels 11, 12 respectively adjoin a rising section 17, 18, and the inlet windows 13, 14 of the transfer channels 11, 12 respectively adjoin an inlet section 19, 20.

In the vicinity of the upper dead center position of the piston 4 illustrated in FIG. 2, fresh air flows through the transfer channels 11, 12 in a direction toward the crankcase 6 in a direction of flow 29, 30. In the region of the lower dead center position of the piston 4, the fresh air and subsequently the fuel/air mixture flows out of the crankcase 6 in the opposite direction of flow 27, 28 from the crankcase 6 into the combustion chamber 3. The transfer channel 11 that is near the outlet 10 has a width b' and a length l' whereby the width b' is measured approximately in the circumferential direction relative to the longitudinal axis 21 of the cylinder 2, and the length l' is the extension of the transfer channel 11 from the outlet window 15 to the inlet window 13. In a corresponding manner, the transfer channel 12 has a width b" and a length l".

Figure 3:
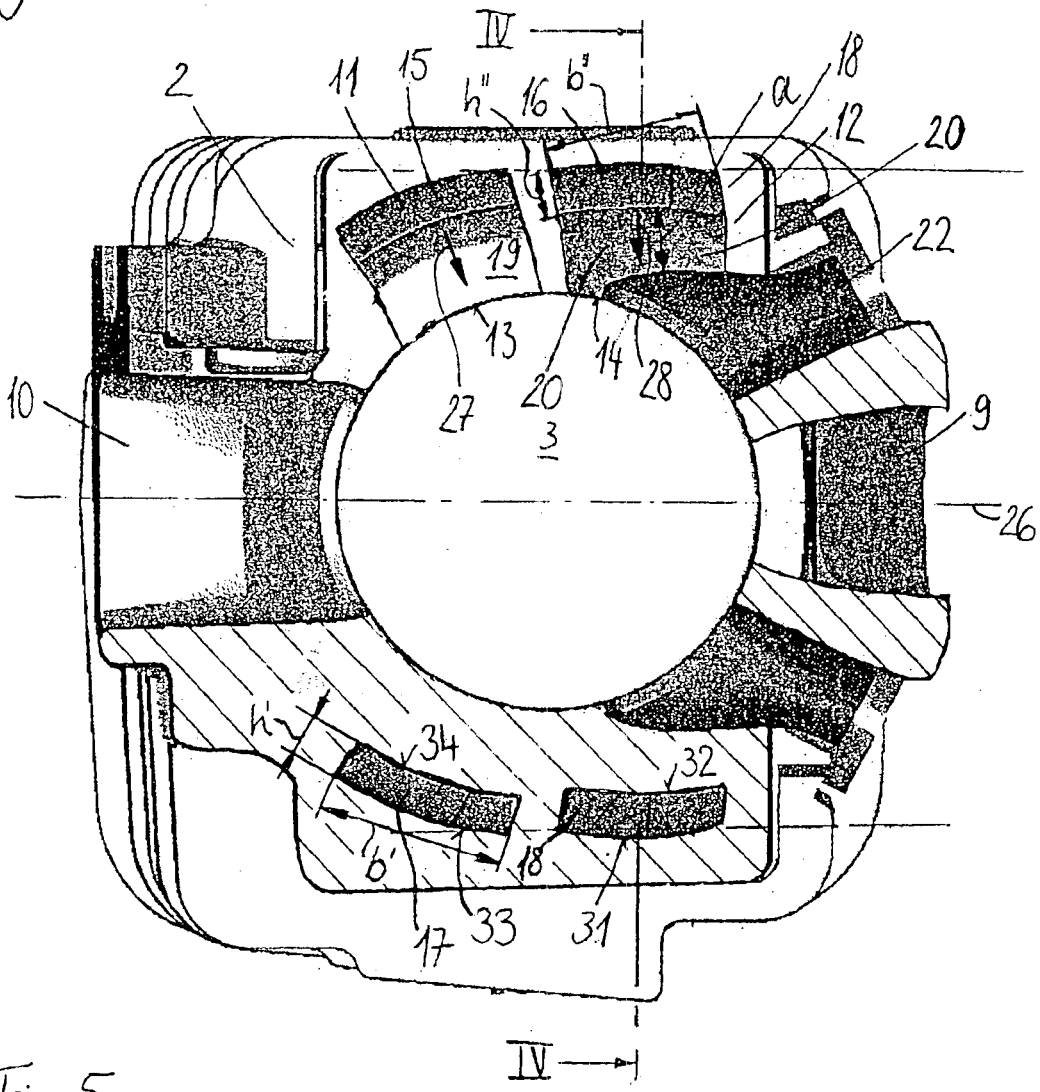
FIG. 3 is a perspective view of the channels in a cylinder of a two-cycle engine in a viewing direction from the crankcase onto the combustion chamber.

FIG. 3 illustrates the cylinder 2 in a viewing direction from the crankcase toward the combustion chamber 3. In this connection, in the upper half, the boundary walls of the channels are shown, and in the half below the central plane 26, a cross-sectional view is shown. The inlet 9 is disposed across from the outlet 10. Disposed symmetrically relative to the central plane 26, which approximately centrally divides the inlet 9 and the outlet 10, are two transfer channels 11 that are near the outlet, and two transfer channels 12 that are remote from the outlet. The transfer channels 12 that are remote from the outlet 10 respectively partially span an air channel 22. The distance a between the rising section 18 of the transfer channel 12 and the respectively associated air channel 22 is approximately constant over the width b" of the transfer channel 12.

The side walls 31 and 32 that are disposed in the direction of the width b" in the rising section 18 of the transfer channels 12 that are remote from the outlet 10 extend approximately parallel to the central plane 26 of the cylinder 2. Thus, on that side that faces the inlet 9 the transfer channels 12 that are remote from the outlet are, as viewed in the radial direction of the cylinder 2, arranged so as to be turned outwardly relative to the arrangement in the circumferential direction. The side walls 33 and 34 that extend in the direction of the width b' in the rising section 17 of the transfer channels 11 that are near the outlet 10 extend approximately in the circumferential direction relative to the cylinder 2.

That side wall 31 in the rising section 18 of the transfer channel 12 that is remote from the outlet 10 that is disposed outwardly in the radial direction extends approximately perpendicular to the flow direction 28 or the oppositely directed flow direction 30 in the inlet section 20. In a corresponding manner, that side wall 33 of the transfer channel 11 in the rising section 17 that is near the outlet 10 that is disposed outwardly in the radial direction extends approximately perpendicular to the flow direction 27 or 29 in the inlet section 19*f* the transfer channel 11 that is near the outlet 10.

The flow cross-section in the transfer channels 11, 12 has an approximately quadrilateral or rectangular shape, whereby the width b', b" is greater than the height h', h" that is measured perpendicular to the width b', b" and to the flow direction 27, 28, 29, 30. The ratio of width b', b" to height h', h" over the length l', l" of the transfer channel 11, 12 is expediently approximately constant. The height h', h" in the outlet window 15, 16 in a transfer channel 11, 12 is expediently 10 to 40% of the with b', b" in this outlet window. Favorable flow conditions result in the transfer channel if the width b', b" in the outlet window 15, 16 is 10 to 40%, especially 20 to 35%, of the length l', l" of the respective transfer channel 11, 12. The height h', h" in the outlet window 15, 16 of a transfer channel 11, 12 is advantageously 2 to 15%, especially 4 to 10%, of the length l', l" of the respective transfer channel 11, 12. The height h', h" in the inlet window 13, 14 is advantageously less than 50%, especially 10 to 30%, of the extension of the piston window 23 in the direction of the longitudinal axis 21 of the cylinder 2 in the region of the respective inlet window 13, 14. The sum of the volumes of the two transfer channels 11 that are near the outlet 10, and of the transfer channels 12 that are remote from the outlet, is advantageously 25 to 50%, especially about 30%, of the stroke volume or piston displacement. The volume of a transfer channel 11, 12 signifies the filling volume between outlet window 15, 16 and inlet window 13, 14.

Figure 5:
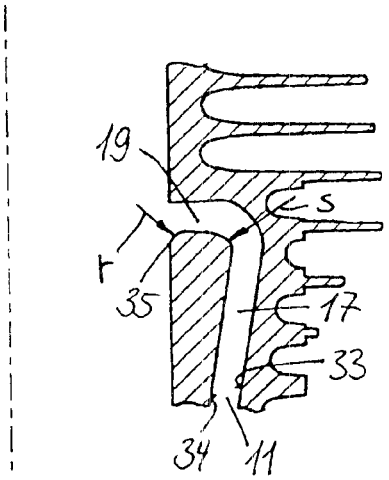
FIG. 5 shows a section of a cross-sectional illustration of a transfer channel in the region of the inlet section.
Figure 4:
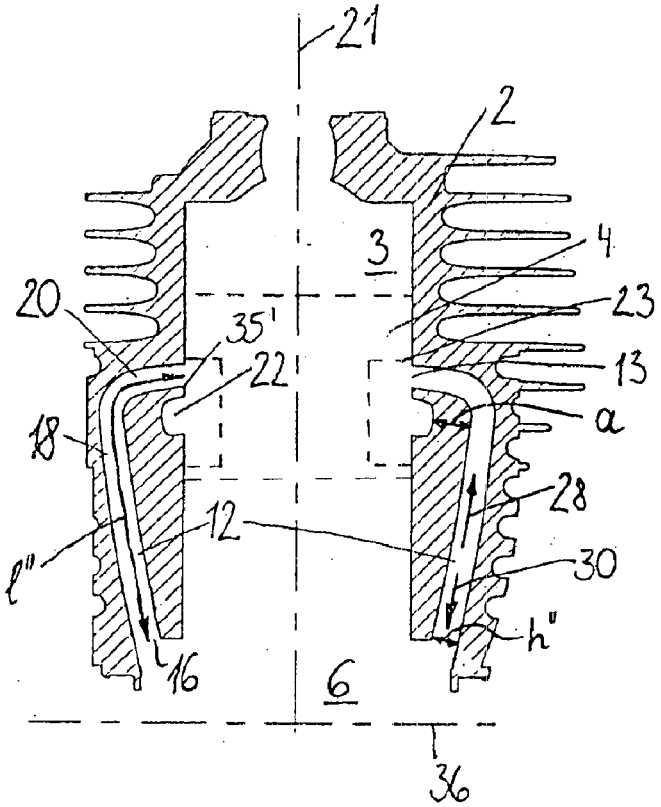
FIG. 4 is a cross-sectional view through a cylinder taken approximately at the level of the line IV—IV in FIG. 3.
Figure 6:
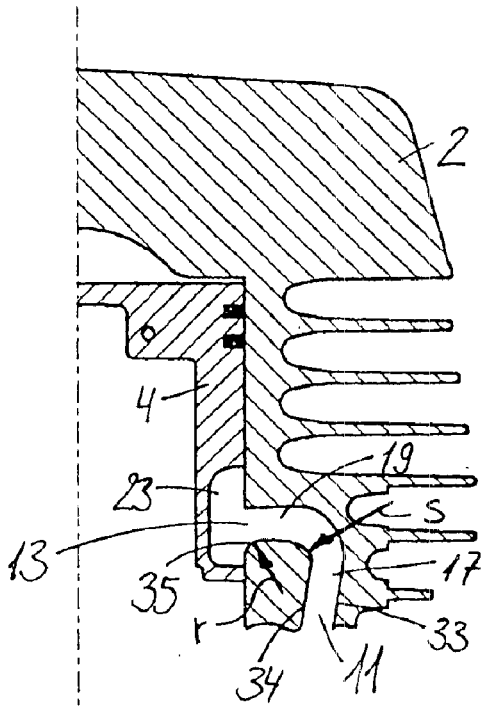
FIG. 6 shows a section of a cross-sectional view through a cylinder.

FIG. 4 illustrates a longitudinal cross-sectional view through a cylinder 2. The position of a piston 4 in a cylinder 2 wherein the transfer channels 12 are fluidically connected with the air channels 22 via piston windows 23 that are disposed symmetrically relative to the central plane 26 is indicated by dashed lines. FIGS. 4 to 6 show adjacent sections through the cylinder 2 and the transfer channel 12 that is remote from the outlet 10 and spans the air channel 22. The distance a between air channel 22 and the rising section 18 of the transfer channel is approximately constant over the width of the transfer channel.

For a favorable flow through the transfer channel in both directions, the resistance to flow in the transfer channel 12 in the flow direction 28 from the crankcase 6 to the combustion chamber 3 corresponds approximately to the resistance to flow in the flow direction 30 from the combustion chamber 3 to the crankcase 6. The shape of the transfer channels 12 that are remote from the outlet 10 is favorable for both directions of flow 28, 30, so that separation of flow from the channel wall, or turbulence, is avoided. The corresponding situation applies to the transfer channels 11 that are near the outlet 10. The flow resistance in the transfer channel 12 is expediently approximately constant over the entire length l". For a complete filling of the transfer channels with air, the flow resistance is advantageously low. For this purpose, the transfer channels have a uniform and low flow resistance that is realized by small cross-sectional changes, large radii, and the avoidance of edges. In this connection, as illustrated in FIG. 4, the length l" extends from the inlet window 13 to the outlet window 16. The change of the flow cross-section in the transfer channel 12 is advantageously 0 to 15% of the flow cross-section in the outlet window 16. In this connection, the change of the flow cross-section is in particular constant over the entire length of the flow cross-section. As a result, sudden changes, and hence turbulence, are avoided in the transfer channel. The edge 35' of the inlet window 13 that faces the combustion chamber 3 can be rounded off.

It is provided that the flow cross-section decreases from the outlet window 16 to the inlet window 13 into the combustion chamber 3. The ratio of the width b" illustrated in FIG. 3 to the height h" of the transfer channel is in this connection nearly constant over the entire length l" of the transfer channel 12. The inlet section 20 in the combustion chamber 3 of the transfer channel 12 extends approximately at a right angle to the rising section 18. The side wall 31 of the transfer channel 12 that is disposed outwardly in a radial direction extends, in the rising section 18, approximately parallel to the side wall 32 that is disposed inwardly in the radial direction, whereby both side walls 31, 32 extend approximately in the direction of the longitudinal axis 21 of the cylinder 2, yet are inclined relative to the axis. The axis 36 of the crankshaft 7 extends at a spacing relative to the outlet window 16, whereby the axis 36 of the crankshaft 7 is, in a direction from the combustion chamber 3 toward the crankcase 6, offset relative to the outlet window 16. The transfer channels 11 that are near the outlet 10 are embodied in a manner corresponding to that of the transfer channels 12 that are remote from the outlet so that similar flow conditions result in all of the transfer channels 12.

Illustrated in FIG. 5 is a section of a transfer channel 11, and in FIG. 6 a section from a cylinder 2. The inlet section 19 respectively extends approximately perpendicular to the rising section 17. At the inlet window 13, via which the transfer channel 11 opens into the combustion chamber 3, there is formed a radius r at the edge 35 of the inlet window 13 that faces the crankcase 6. This radius reduces the flow resistance and flow separation for the air that flows out of the air channel 22 into the transfer channel 11 via the piston window 23 that is illustrated in FIG. 6. In this connection, the magnitude of the radius r can be approximately in the range of the magnitude of the deflection radius s. In particular, the deflection radius s is less than the radius r. In this connection, the deflection radius s is the deflection radius from the inner side wall 34 into the inlet section 19. A corresponding radius is expediently also formed in the transfer channel 12 that is remote from the outlet 10. For a good filling of the transfer channels 11, 12, it is provided that the flow resistance in the transfer channels 11, 12 be as low as possible. For this purpose, the deflection radius s and the radius r are advantageously large.

The cylinder 2, with the transfer channels 11, 12 and the air channels 22 formed therein, is expediently produced in a lost core casting process. In this way, the inner contours of the transfer channels can be formed largely clear, so that uniform flow cross-sections without disruptive burrs or the like can be formed.

The specification incorporates by reference the disclosure of German priority document 102 23 069.2 filed May 24, 2002.

The present invention is, of course, in no way restricted to the specific disclosure of the specification and drawings, but also encompasses any modifications within the scope of the appended claims.

We claim:

1. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein a ratio of a width of said at least one transfer channel as measured in a circumferential direction, to a height of said at least one transfer channel, as measured perpendicular to said width and to a direction of flow, is approximately constant over a length of said at least one transfer channel.

2. A two-cycle engine according to claim 1, wherein a flow cross-section in said at least one transfer channel is nearly constant, and wherein a change of said flow cross-section is 0 to 15% of a flow cross-section in said outlet window.

3. A two-cycle engine according to claim 1, wherein a flow cross-section in said at least one transfer channel decreases from said crankcase to said combustion chamber.

4. A two-cycle engine according to claim 1, wherein a flow cross-section of said at least one transfer channel has an approximately quadratic shape.

5. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, wherein a flow cross-section of said at least one transfer channel has an approximately guadractic shape, and wherein a height in said outlet window corresponds to 10 to 40% of a width in said outlet window.

6. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein a width in said outlet window corresponds to 10 to 40% of a length of said at least one transfer channel.

7. A two-cycle engine according to claim 6, wherein said width in said outlet window corresponds to 20 to 35% of said length of said at least one transfer channel.

8. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately Parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein a height in said outlet window corresponds to 2 to 15% of a length of said at least one transfer channel.

9. A two-cycle engine according to claim 8, wherein said height in said outlet window corresponds to 4 to 10% of said length of said at least one transfer channel.

10. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein two first transfer channels that are near said outlet, and two second transfer channels that are remote from said outlet, are provided and wherein said first and second transfer channels are disposed symmetrically relative to a central plane of said cylinder.

11. A two-cycle engine according to claim 10, wherein one of said second transfer channels that is remote from said outlet at least partially spans said air channel, and wherein a spacing between said air channel and said one second transfer channel is approximately constant over a width of said one second transfer channel.

12. A two-cycle engine according to claim 10, wherein side walls of at least one of said second transfer channels that are remote from said outlet are disposed in a direction of a width of said transfer channel and extend approximately parallel to said central plane of said cylinder.

13. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein side walls of at least one of said at least one transfer channel that are disposed outwardly in a radial direction extend, in said rising section approximately perpendicular to a direction of flow in said inlet section.

14. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein said at least one transfer channel is rounded off towards said combustion chamber at an edge of said inlet window that faces said crankcase.

15. A two-cycle engine comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is disposed approximately opposite said inlet for exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, and opens into said crankcase via an outlet window wherein said at least one transfer channel has a rising section that extends approximately parallel to a longitudinal axis of said cylinder, and an inlet section into said combustion chamber, wherein an air channel is provided for conveying air that is essentially free of fuel, wherein in prescribed positions of said piston said air channel is fluidically connected via a piston window with said inlet window of said at least one transfer channel, wherein said at least one transfer channel has a flow resistance therethrough in a direction of flow from said crankcase to said combustion chamber that corresponds approximately to a flow resistance therethrough in a direction of flow from said combustion chamber to said crankcase, and wherein a sum of the volumes of all transfer channels is 25 to 50% of a piston displacement of said engine.

16. A two-cycle engine according to claim 15, wherein said sum of said volumes is about 30% of said piston displacement of said engine.

* * * * *